United States Patent [19]

Feldmann

[11] 4,042,210

[45] Aug. 16, 1977

[54] ADJUSTABLE LEVERAGE PRY BAR

[76] Inventor: William F. Feldmann, R.R. No. 1, O'Fallon, Ill. 62269

[21] Appl. No.: 700,855

[22] Filed: June 29, 1976

[51] Int. Cl.[2] ..... B66F 3/00

[52] U.S. Cl. ..... 254/26 R

[58] Field of Search ..... 254/21, 25, 26, 27, 254/131; 29/267

[56] References Cited

U.S. PATENT DOCUMENTS

| | | | |
|---|---|---|---|
| 119,770 | 10/1871 | Ives | 254/25 |
| 206,902 | 8/1878 | Scribner | 254/27 |
| 1,890,273 | 12/1932 | Wells | 254/131 |
| 2,890,018 | 6/1959 | Johnson | 254/26 R |
| 2,894,720 | 7/1959 | Bennett | 254/131 |
| 2,907,106 | 10/1959 | Lockwood | 254/131 |
| 3,029,502 | 4/1962 | Middaugh | 29/267 |
| 3,134,574 | 5/1969 | Reuterfors | 254/25 |
| 3,836,119 | 9/1974 | Saucier et al. | 254/131 |

*Primary Examiner*—Al Lawrence Smith
*Assistant Examiner*—Robert C. Watson
*Attorney, Agent, or Firm*—Clarence A. O'Brien; Harvey B. Jacobson

[57] ABSTRACT

An adjustable leverage pry tool having a lever including a handle portion and a pry portion connected to the handle portion and in the form of an arcuate plate provided with a claw. Mounted on the pry portion is a fulcrum member which is movable along the arcuate plate between the claw and the handle portion for varying the angle and amount of leverage exerted by the lever. The cross section of the fulcrum member is elliptical and has its longest axis disposed at an acute angle with respect to the arcuate plate in order to enhance the leverage of the tool.

3 Claims, 4 Drawing Figures

10
12
14
16
18
20
22
24
26
28
30
40
3
3

16'
42
44

16
18
22
24
26
30
32
34
36
38
S 16
22
24
26
28
S

ADJUSTABLE LEVERAGE PRY BAR

BACKGROUND OF THE INVENTION

1. Field of the Invention

This invention relates generally to prying tools, and particularly to an adjustable leverage pry bar which can be used whenever there is a need for a leverage tool.

2. Description of the Prior Art

It is known to construct a prying tool in the form of a lever provided with an adjustable fulcrum member. Examples of such devices can be found in U.S. Pat. Nos. 1,266,215, issued May 14, 1918 to J. T. Coneeny et al.; and 2,670,923, issued Mar. 2, 1954 to F. F. Chiles. U.S. Pat. No. 3,029,502, issued Apr. 17, 1962 to F. R. Middaugh, discloses a pry bar on which is slidably disposed a fulcrum member in the form of a sphere. While U.S. Pat. No. 1,266,215 discloses a pry bar which has a great deal of permissible variation as regards the point of the fulcrum and the amount of leverage which may be exerted by the tool, it is rather complex in construction and relies on a pivot which limits the strength of the bar. Further, the tool disclosed in U.S. Pat. No. 3,029,502, while very simple, is not as flexible as the tool disclosed in U.S. Pat. No. 1,266,215.

SUMMARY OF THE INVENTION

It is an object of the present invention to provide a pry tool which is both simple in construction and flexible in operation.

It is another object of the present invention to provide an adjustable leverage pry tool which is capable of adjustment in a simple and reliable manner so as to obtain any desired amount of leverage.

These and other objects are achieved according to the present invention by providing an adjustable leverage pry tool having: a lever including a pry portion and a handle portion; a claw provided on the pry portion; and a fulcrum member adjustably mounted on the pry portion and arranged movable between the handle portion and the claw for varying the amount of leverage exerted by the lever.

The pry portion advantageously extends longitudinally from the handle portion to the claw, and is preferably in the form of a longitudinal arcuate member arranged for varying the angle of leverage as well as the amount of leverage by movement of the fulcrum member along the longitudinal extent of the arcuate member.

The fulcrum member preferably includes an elongated element provided with a slot in which the arcuate member of the pry portion is slidably received. A clamp is attached to the elongated element for releasably securing the elongated element to the arcuate member in any position desired between the handle portion and the claw.

According to a particularly advantageous feature of the present invention, the elongated element forming the body of the clamp has a substantially elliptical transverse cross section for enhancing the leverage of the lever. The slot through the elongated element is at an acute angle with respect to the longest axis of this elliptical cross section so as to cause a shift in the fulcrum of the arcuate member as the lever is pivoted about the fulcrum member.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
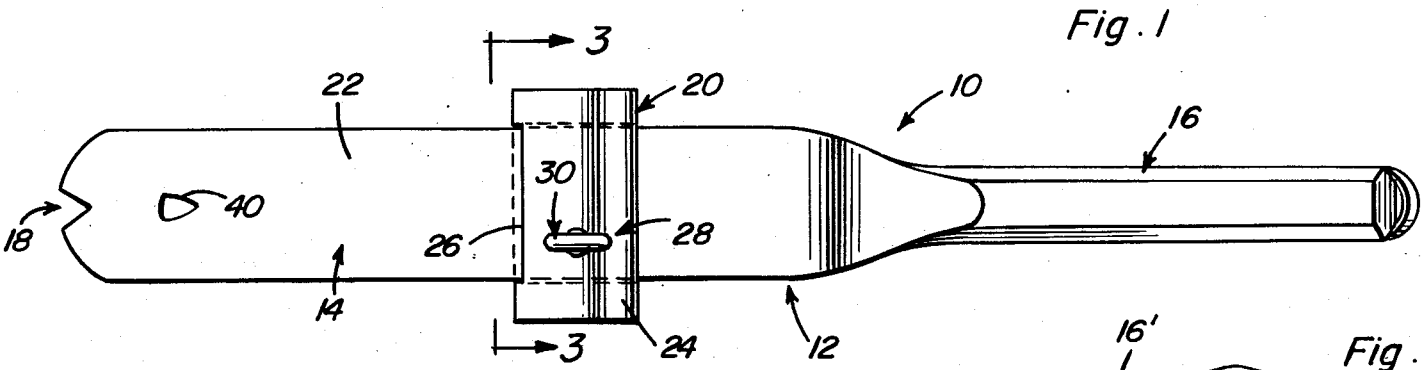
FIG. 1 is a top plan view showing a pry tool according to the present invention.
Figure 2:
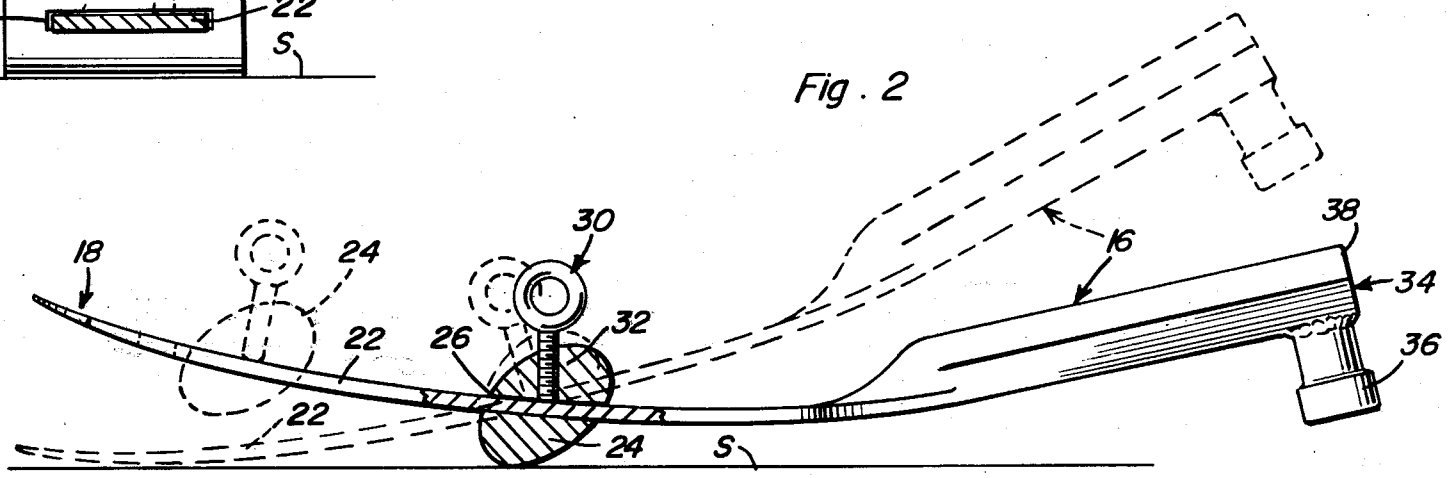
FIG. 2 is a side elevational view showing the pry tool of FIG. 1, with the broken lines indicating shifted positions of both the pry tool per se and the fulcrum member therealong.
Figure 3:
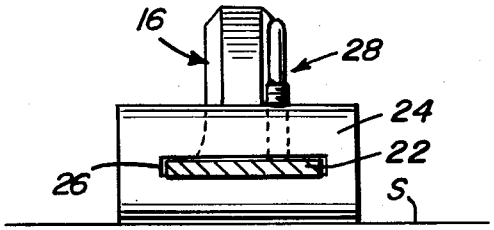
FIG. 3 is a sectional view taken generally along the line 3—3 of FIG. 1.

Referring now more particularly to FIGS. 1 through 3 of the drawing, an adjustable leverage pry tool 10 according to the invention is formed around a lever 12 which includes a pry portion 14 and a handle portion 16. A claw 18 is provided on a forwardly directed end of pry portion 14 for engagement with an article or structure to be pried and/or lifted. Adjustably mounted on pry portion 14 is a fulcrum member 20 movable between handle portion 16 and claw 18 for varying the amount of leverage exerted by lever 12.

Pry portion 14 extends longitudinally from handle portion 16 to claw 18 and is in the form of a longitudinal arcuate member advantageously in the form of the illustrated plate 22. By making plate 22 arcuate, movement of fulcrum member 20 along plate 22 will vary the angle of leverage as well as the amount of leverage exerted by tool 10.

Fulcrum member 20 preferably includes an elongated element 24 provided with a slot 26 in which the arcuate plate 22 of pry portion 14 is slidably received so as to permit elongated element 24 to slide along pry portion 14. A clamp 28 is attached to elongated element 24 for releasably securing element 24 to plate 22 at a desired location thereon. As can be seen from FIG. 2, elongated element 24 has a substantially elliptical transverse cross section for enhancing the leverage of the tool 10. That is, the elliptical cross section of element 24 will provide for a shift of the fulcrum of lever 12 toward the surface S supporting the element 24 while minimizing shift of the tip of claw 18 in the longitudinal direction of tool 10 so as to retain the initial contact with the article or structure being forced and enhancing the leverage exerted by the lever 12. That is, the point of contact between element 24 and surface S will actually move slightly away from the tip of claw 18 as handle 16 of lever 12 is moved clockwise between the broken line position and the full line position in FIG. 2 so as to increase the moment arm being exerted on an article or structure (not shown) being forced while the tip of claw 18 remains in a substantially vertical plane. The slot 26 is advantageously disposed at an acute angle with respect to the longest axis or dimension of the cross section of element 24 in order to achieve optimum desired results of the curvature of the periphery of element 24. It is to be understood that by the term "elliptical" is meant oval, or egg-shaped, cross sections as well as the elliptical form shown in FIG. 2.

The broken line showing of element 24 at the leftmost portion of blade 22, adjacent claw 18, in FIG. 2 shows how the fulcrum member 20 can be moved along the plate 22 in order to change the moment arm formed between element 24 and claw 18.

Clamp 28 is illustrated as in the form of a thumbscrew 30 threadingly engaged in a threaded bore 32 provided in elongated element 24 and communicating with the surface of plate 22. Thus, by simple manipulation of thumbscrew 30, element 24 can be releasably secured to the plate 22 in a desired position along the extent of the plate.

Handle portion 16 extends longitudinally from pry portion 14 and terminates in an impact imparting and sustaining head 34. This head 34 can impart blows as by a hammer portion 36, and can permit blows to be received by the tool as by impact surface 38 and cause the blows to be transmitted to the pry portion 14 as desired during conventional use of tool 10.

Tool 10 can also be provided with nail pullers, such as the one designated 40 formed in plate 22 adjacent claw 18. It will be appreciated that the V-portion of claw 18 can also be used as a nail puller.

Figure 4:
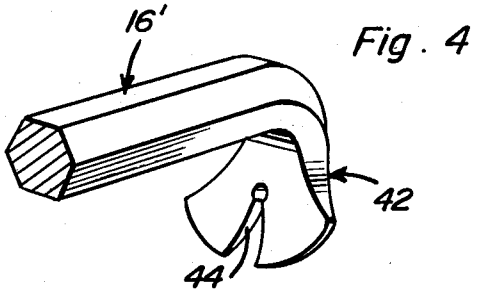
FIG. 4 is a fragmentary, perspective view showing a modified form of a leverage tool according to the present invention.

Referring now to FIG. 4, a handle portion 16′ is illustrated which terminates in a further claw 42 provided with, for example, a nail puller 44. Thus, it will be understood that handle portion 16, 16′ can terminate in various typical tools provided the shape of the tool so terminating the handle portion can be employed as an impact receiving member facilitating use of the tool as a pry bar.

As will be readily understood from the above description and from the drawing, a pry tool according to the present invention provides an adjustable fulcrum which permits the amount of angle of leverage to be adjusted in order to obtain any desired amount of leverage. The tool can be used whenever leverage is needed, and can be operated either with one's foot or one's hand. Also, the head 34 and claw 42 enable the handle portion 16 to move downwardly toward a surface without danger of the fingers of a person using the device becoming injured in the event the tapered end of the pry portion becomes disengaged from the article or structure to which it is imparting a force. The fulcrum itself is of an advantageous shape being elliptical in cross section, because in this manner leverage is more easily obtained and retained. The fact that the fulcrum member slides means that the claw of the tool can be placed in a small opening or in a large opening without sacrificing maximum leverage. A tool according to the invention can be made to be used by any trade and constructed in different sizes, and can also be forged in one piece in order to reduce manufacturing costs.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An adjustable leverage pry tool, comprising, in combination:

a. a lever including a pry portion and a handle portion;

b. a claw provided on the pry portion; and c. a fulcrum member adjustably, slidably mounted on the pry portion and arranged movable between the handle portion and the claw for varying the amount of leverage exerted by the lever, the fulcrum member having a substantially elliptical transverse cross section for enhancing the leverage of the lever, the pry portion extending longitudinally from the handle portion to the claw, and being in the form of a longitudinal arcuate member arranged for varying the angle of leverage as well as the amount of leverage by movement of the fulcrum member between the handle portion and the claw, the fulcrum member including, in combination:

1. an elongated member provided with a slot in which the arcuate member of the pry portion is slidably received; and 2. clamp means attached to the elongated element for releasably securing the elongated element to the arcuate member, the clamp means including a thumbscrew, and a threaded bore provided in the elongated element, the thumbscrew disposed movably threadingly engaged in the bore and releasably gripping the arcuate member.

2. A structure as defined in claim 1, wherein the handle portion extends longitudinally from the pry portion and terminates in an impact imparting and sustaining head, the head permitting blows to be received by the tool and transmitted to the pry portion.

3. A structure as defined in claim 1, wherein the handle portion extends longitudinally from the pry portion and terminates in a further claw disposed at substantially a right angle to the extent of the handle portion.

* * * * *